US011896101B2

(12) United States Patent
Rahimi

(10) Patent No.: US 11,896,101 B2
(45) Date of Patent: Feb. 13, 2024

(54) LUGGAGE CONNECTING ASSEMBLY

(71) Applicant: Shakiba Rahimi, East Meadow, NY (US)

(72) Inventor: Shakiba Rahimi, East Meadow, NY (US)

( * ) Notice: Subject to any disclaimer, the term of this patent is extended or adjusted under 35 U.S.C. 154(b) by 0 days.

(21) Appl. No.: 17/232,139

(22) Filed: Apr. 15, 2021

(65) Prior Publication Data

US 2023/0329403 A1 Oct. 19, 2023

Related U.S. Application Data

(60) Provisional application No. 63/011,250, filed on Apr. 16, 2020.

(51) Int. Cl.
*A45C 5/03* (2006.01)
*A45C 5/14* (2006.01)

(52) U.S. Cl.
CPC . *A45C 5/03* (2013.01); *A45C 5/14* (2013.01)

(58) Field of Classification Search
CPC ..... A45C 5/03; A45C 5/14
USPC ..... 190/18 A, 108; 217/13
See application file for complete search history.

(56) References Cited

U.S. PATENT DOCUMENTS 1,084,360 A * 1/1914 Rahm ..... A45C 7/0045 190/108
2,574,033 A 11/1951 Harper
3,310,970 A 3/1967 Humphries
3,952,561 A 4/1976 Bako
5,689,979 A 11/1997 Yu
6,073,737 A * 6/2000 Kang ..... A45C 7/0045 280/460.1
6,522,253 B1 2/2003 Saltus
9,524,600 B2 12/2016 Yong et al.
(Continued)

FOREIGN PATENT DOCUMENTS

WO WO-2019023736 A1 * 2/2019 ..... A45C 13/1069
WO WO-2019117823 A2 * 6/2019 ..... A45C 13/262

OTHER PUBLICATIONS

Tach: V3 3-Piece Hardcase Connectable Luggage https://www.amazon.com/TACH-Hardcase-Connectable-Suitcase-Connecting/dp/B07JQTX961 (Year: 2019).*

*Primary Examiner* — John K Fristoe, Jr.
*Assistant Examiner* — Justin Caudill
(74) *Attorney, Agent, or Firm* — José W. Jimenez; JIMINEZ LAW FIRM

(57) ABSTRACT

A luggage connector assembly for ease of transport of various luggage members in tandem, the connector assembly including one or more telescopically retractable knob assemblies slidably coupled to a first portable case assembly along one or more rail assemblies. One or more C-shaped latch assemblies are coupled to at least one second portable case assembly and designed to slidably receive an end portion of the one or more telescopically retractable knob assemblies when the one or more telescopically retractable knob assemblies are extended. A substantially rigid arch inside the one or more C-shaped latch assemblies restrains the sideways movement of the one or more telescopically retractable knob assemblies. The slotted rail pair assembly is designed to restrain the one or more telescopically retractable knob assemblies from sideways movement while permitting longitudinal movement along the slotted rail pair assembly.

20 Claims, 12 Drawing Sheets

(56) References Cited

U.S. PATENT DOCUMENTS

| | | | | |
|---|---|---|---|---|
| 10,076,166 | B2 * | 9/2018 | Kim | A45C 5/03 |
| 2004/0226324 | A1 | 11/2004 | Loughlin et al. | |
| 2006/0218978 | A1 | 10/2006 | Toler et al. | |
| 2007/0158157 | A1 | 7/2007 | Krulik et al. | |
| 2008/0209957 | A1 | 9/2008 | Araujo | |
| 2008/0308369 | A1 * | 12/2008 | Louis | A45C 7/0045 190/108 |
| 2010/0059323 | A1 * | 3/2010 | Marji | A45C 7/0045 190/18 A |
| 2011/0186397 | A1 | 8/2011 | Sheikh | |
| 2013/0213753 | A1 * | 8/2013 | Salek | A45C 13/30 190/18 A |
| 2013/0264128 | A1 | 10/2013 | Plato et al. | |
| 2013/0333996 | A1 * | 12/2013 | Selvi | A45C 13/1092 190/18 A |
| 2014/0283565 | A1 | 9/2014 | Edwards | |
| 2015/0300049 | A1 | 10/2015 | Majeau | |
| 2017/0081884 | A1 | 3/2017 | Meersschaert et al. | |
| 2017/0181514 | A1 * | 6/2017 | Castillo Machado | A45C 13/262 |
| 2021/0378373 | A1 * | 12/2021 | Bryan | A45C 13/00 |

* cited by examiner

LUGGAGE CONNECTING ASSEMBLY

CLAIM OF PRIORITY

This application claims the benefit of and priority to U.S. provisional application No. 63/011,250, filed on Apr. 16, 2020, titled LUGGAGE CONNECTING ASSEMBLY, the contents of which are incorporated by reference in their entireties.

FIELD OF THE INVENTION

The inventive concept relates generally to a luggage connecting assembly.

BACKGROUND

Currently, there are a number of solutions for carrying multiple luggage bags. One of these solutions attempts to tie luggage together, but this solution fails to meet the needs of the market because chords or straps may come untied. Another solution attempts to use both hands to carry the luggage but this solution is similarly unable to meet the needs of the market because the user may have more luggage than available hands. Still another solution seeks to stack the luggage, but this solution also fails to meet market needs because the luggage may be too large or awkward to stack. Therefore, there currently exists a need in the market for an apparatus that connects multiple bags together for transport.

SUMMARY OF THE INVENTION

The inventive concept is a luggage connector assembly for ease of transport of various luggage members. One or more telescopically retractable knob assemblies are slidably coupled to a first portable case assembly, the one or more telescopically retractable knob assemblies having a distal end portion, a middle portion, and a proximal end portion, the middle portion narrower than the distal end portion and the proximal end portion. One or more C-shaped latch assemblies with an upper portion and a lower portion is coupled to at least one second portable case assembly and designed to slidably receive the proximal end portion of the one or more telescopically retractable knob assemblies when the one or more telescopically retractable knob assemblies are in an extended position. A substantially rigid arch assembly is disposed within the lower portion of the one or more C-shaped latch assemblies and is designed to restrain the sideways movement of the proximal end portion of the one or more telescopically retractable knob assemblies. At least one slotted rail pair assembly is coupled to the first portable case assembly with the at least one slotted rail pair assembly having a right-side portion and a left side portion, the at least one slotted rail pair assembly further having a proximal face and a distal face.

In this example embodiment, a gap separates the right side portion and the left side portion of the at least one slotted rail pair through which the middle portion of the one or more telescopically retractable knob assemblies are disposed, the gap narrower than the width of the distal end portion and the proximal end portion of the one or more telescopically retractable knob assemblies and designed to restrain the one or more telescopically retractable knob assemblies from sideways movement while permitting longitudinal movement of the one or more telescopically retractable knob assemblies. One of ordinary skill in the art would recognize the inventive concept is optimized by having two or more wheel members disposed on a base portion of at least the first portable case assembly.

In one embodiment of the luggage connector assembly, two or more of the one or more telescopically retractable knob assemblies are functionally coupled such that extending or retracting one of the one or more telescopically retractable knob assemblies on the portable case assembly correspondingly extends or retracts at least a second of the one or more telescopically retractable knob assemblies.

In one embodiment of the luggage connector assembly, the one or more telescopically retractable knob assemblies are locked in an extended position or a retracted position using a lock and spring assembly.

In one embodiment of the luggage connector assembly, the open portion of the C-shape latch assemblies are upwardly disposed and designed to slidably receive and couple to the proximal end portion of the one or more telescopically retractable knob assemblies from the top.

In one embodiment of the luggage connector assembly, at least one flexible strip of metal or plastic with interlocking projections that is closed and opened by pulling a slide member along them (also known as a zipper) is disposed on at least the first portable case assembly.

In one embodiment of the luggage connector assembly, a lock member is disposed on at least the first portable case assembly designed to be removably coupled to the slide member when in a locked state.

In one embodiment of the luggage connector assembly, at least the first portable case assembly has four wheel assemblies coupled to a base portion of the portable case assembly, the four wheel assemblies each having at least one wheel member.

In another embodiment of the luggage connector assembly for ease of transport of various luggage members, the luggage connector assembly has one or more telescopically retractable knob assemblies slidably coupled to each of a first portable case assembly, a second portable case assembly, and a third portable case assembly, the one or more telescopically retractable knob assemblies having a distal end portion, a middle portion, and a proximal end portion, the middle portion narrower than the distal end portion and the proximal end portion. One or more C-shaped latch assemblies with an upper portion and a lower portion are disposed on each of the first portable case assembly, the second portable case assembly, and the third portable case assembly to at least one or more of the first portable case assembly, the second portable case assembly, and the third portable case assembly and designed to slidably receive the proximal end portion of the one or more telescopically retractable knob assemblies when the one or more telescopically retractable knob assemblies are in an extended position. A substantially rigid arch assembly is disposed within the lower portion of the one or more C-shaped latch assemblies designed to restrain the sideways movement of the proximal end portion of the one or more telescopically retractable knob assemblies.

In this example embodiment, at least one slotted rail pair assembly is coupled to each the first portable case assembly, the second portable case assembly, and the third portable case assembly, with the at least one slotted rail pair assembly having a right side portion and a left side portion, the at least one slotted rail pair assembly on each the first portable case assembly, the second portable case assembly, and the third portable case assembly further having a proximal face and a distal face. A gap separating the right side portion and the left side portion of the at least one slotted rail pair of each the first portable case assembly, the second portable case assembly, and the third portable case assembly through which the middle portion of the one or more telescopically retractable knob assemblies are disposed, the gap narrower than the width of the distal end portion and the proximal end portion of the one or more telescopically retractable knob assemblies and designed to restrain the one or more telescopically retractable knob assemblies from sideways movement while permitting longitudinal movement of the one or more telescopically retractable knob assemblies.

In this embodiment of the luggage connector assembly, two or more of the one or more telescopically retractable knob assemblies are functionally coupled such that extending or retracting one of the one or more telescopically retractable knob assemblies on each the first portable case assembly, the second portable case assembly, and the third portable case assembly correspondingly extends or retracts at least a second of the one or more telescopically retractable knob assemblies on the respective first portable case assembly, second portable case assembly, and third portable case assembly.

In this embodiment of the luggage connector assembly, the one or more telescopically retractable knob assemblies on each the first portable case assembly, the second portable case assembly, and the third portable case assembly is locked in an extended position or a retracted position using a lock and spring assembly.

In this embodiment of the luggage connector assembly, the open portion of the C-shape latch assemblies are upwardly disposed and designed to receive and couple to slidably receive the proximal end portion of the one or more telescopically retractable knob assemblies from the top.

In this embodiment of the luggage connector assembly, at least one flexible strip of metal or plastic with interlocking projections that is closed and opened by pulling a slide member along them is disposed on at least the first portable case assembly, a lock member is disposed on at least the first portable case assembly designed to be removably coupled to the slide member when in a locked state.

In this embodiment of the luggage connector assembly, each the first portable case assembly, the second portable case assembly, and the third portable case assembly has four-wheel assemblies coupled to a base portion of each the first portable case assembly, the second portable case assembly, and the third portable case assembly, the wheel assemblies having at least one wheel member each.

One of ordinary skill in the art would recognize that the C-shaped latch assembly could also be U-shaped and receive the telescopically retractable knob assemblies from the top down instead of from the side. It would be advantageous to have a luggage connector assembly that is lockable.

The inventive concept advantageously fills the aforementioned deficiencies by providing luggage connecting hooks or knobs, which provides a way for users to travel with multiple bags attached to one another.

The luggage connector assembly has slide members and lock knobs or hooks. One of ordinary skill in the art would recognize the usefulness of hanging other items on the knobs or hooks such as a purse, computer laptop bag, or briefcase. The luggage connector assembly fulfills the need for luggage attaching knobs or hooks.

Among other things, it is an advantage of the inventive concept to provide luggage connecting knobs or hooks that do not suffer from problems or deficiencies associated with prior solutions.

The inventive concept now will be described more fully hereinafter with reference to the accompanying drawings, which are intended to be read in conjunction with both this summary, the detailed description, and any preferred and/or particular embodiments specifically discussed or otherwise disclosed. This inventive concept may, however, be embodied in many different forms and should not be construed as limited to the embodiments set forth herein; rather, these embodiments are provided by way of illustration only and so that this disclosure will be thorough, complete, and will fully convey the full scope of the inventive concept to those skilled in the art.

DETAILED DESCRIPTION OF THE INVENTION

Figure 1:
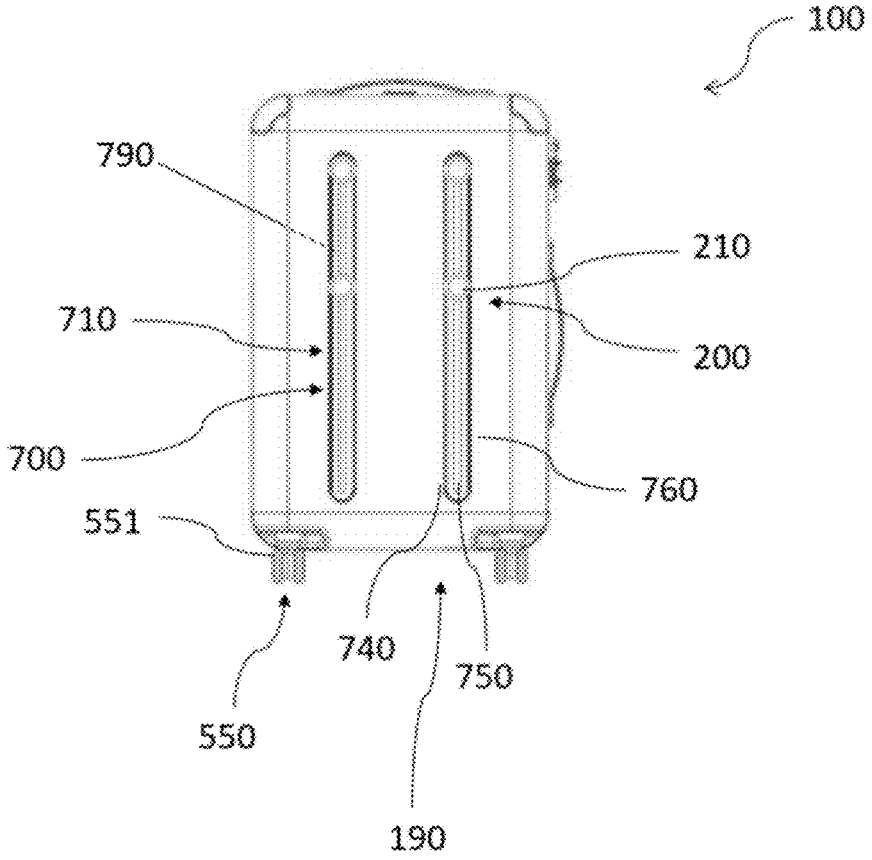
FIG. 1 illustrates a front side view of the luggage connector assembly.
Figure 2:
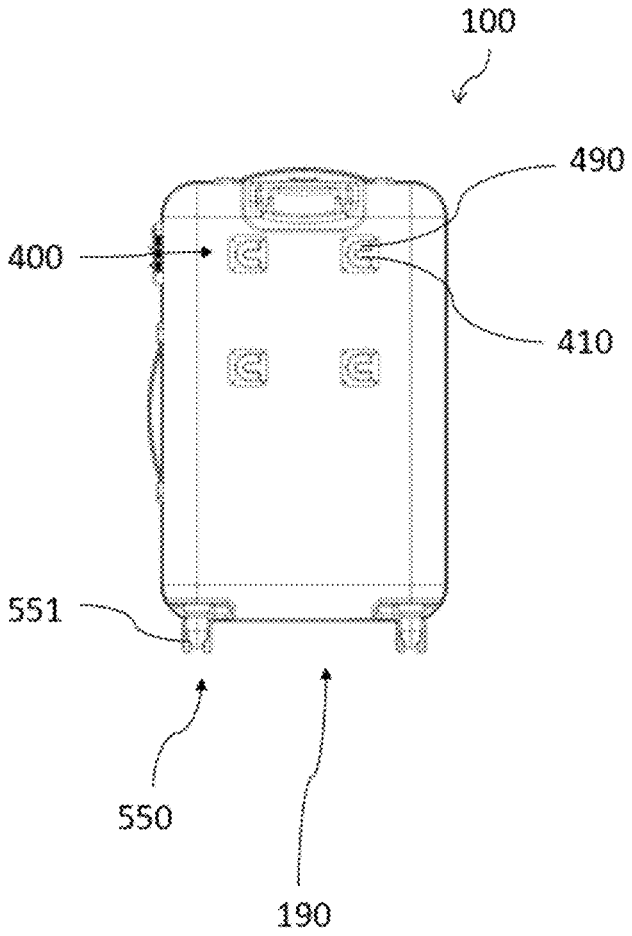
FIG. 2 illustrates a back side view of the luggage connector assembly.
Figure 3:
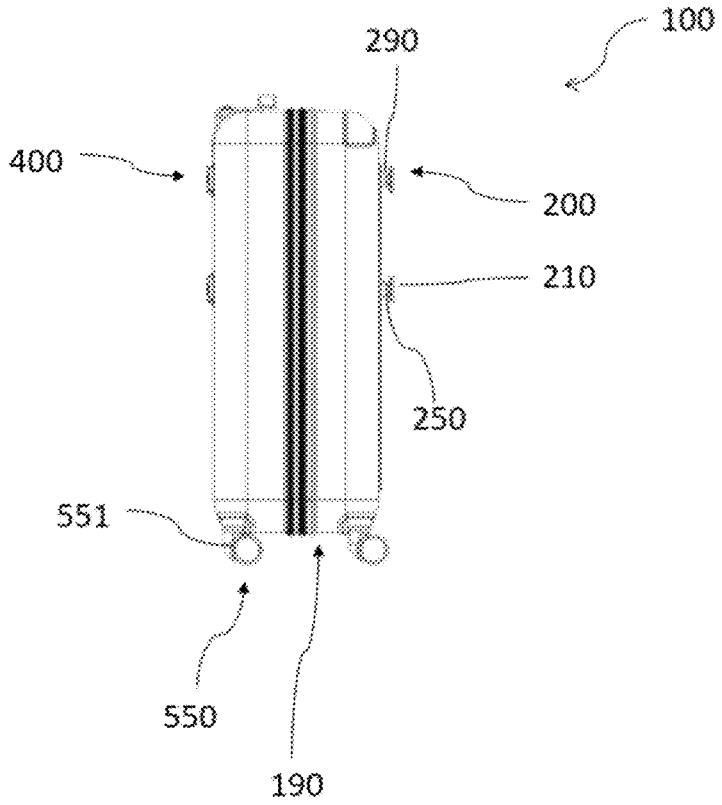
FIG. 3 illustrates a right side view of the luggage connector assembly.
Figure 4:
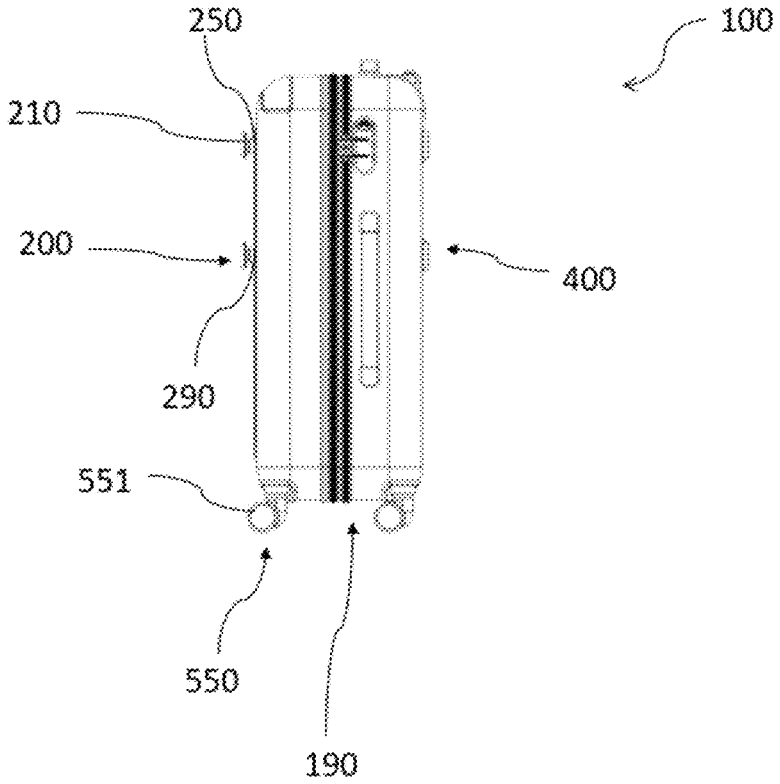
FIG. 4 illustrates a left side view of the luggage connector assembly.
Figure 5:
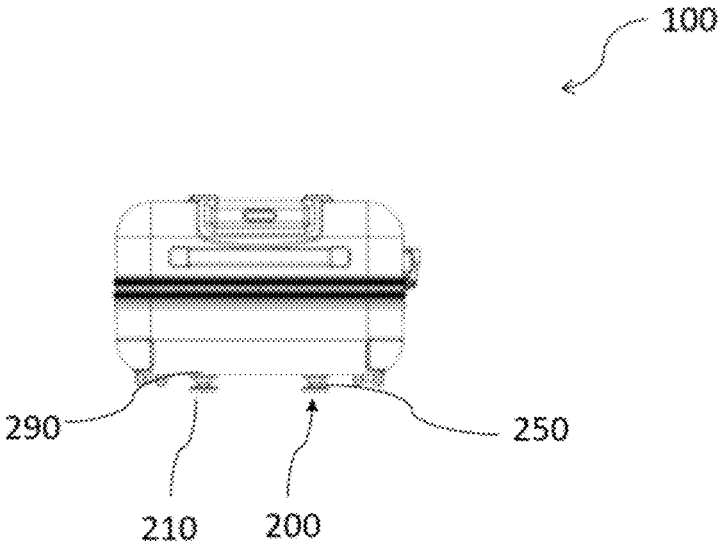
FIG. 5 illustrates a top side view of the luggage connector assembly.
Figure 6:
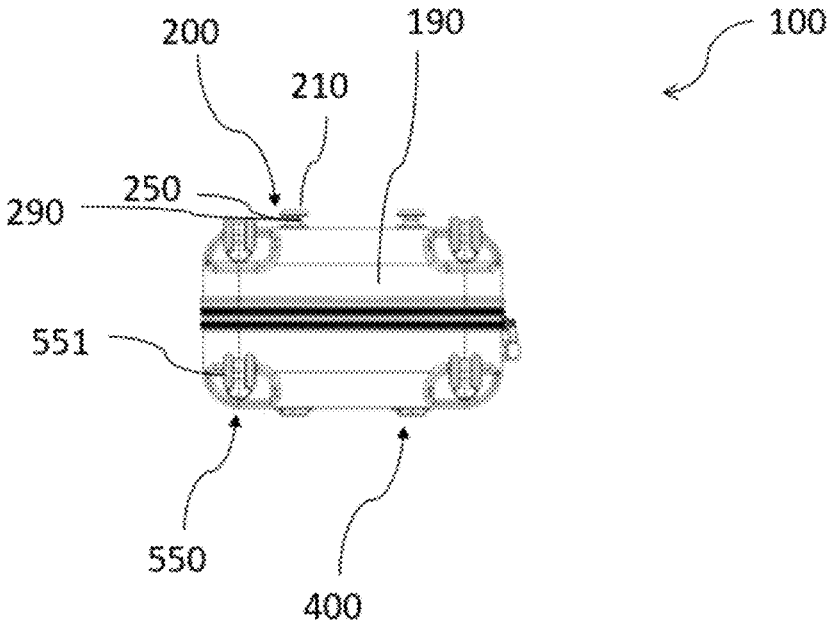
FIG. 6 illustrates a bottom side view of the luggage connector assembly.
Figure 7:
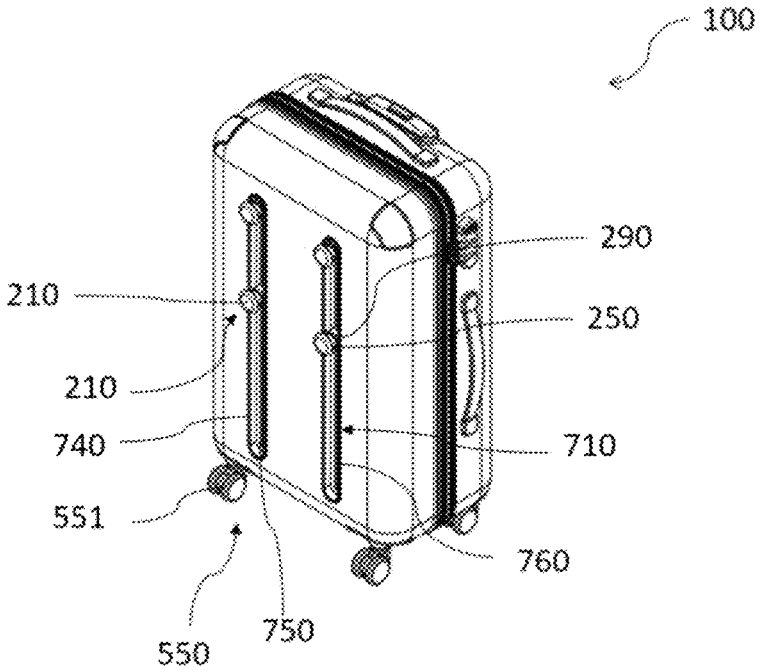
FIG. 7 illustrates a perspective view of the luggage connector assembly.
Figure 8:
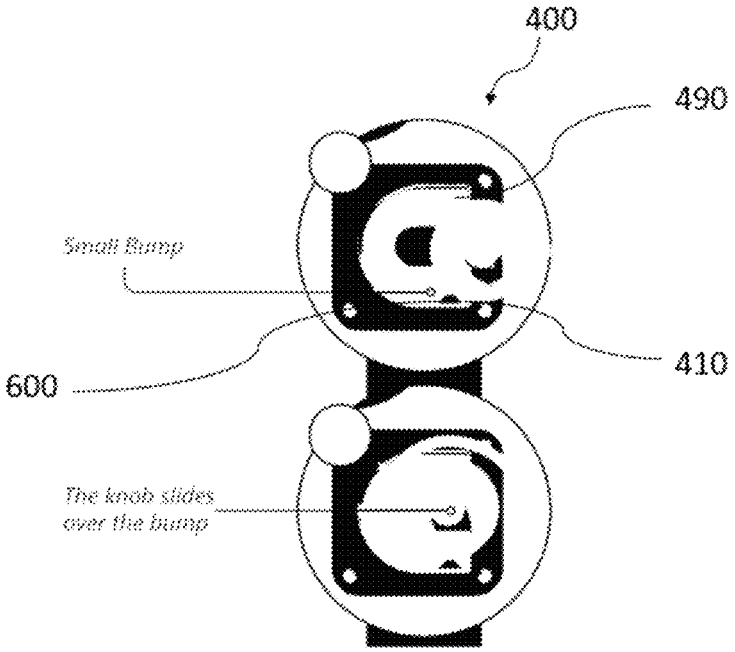
FIG. 8 illustrates a substantially rigid arch.

Following are more detailed descriptions of various related concepts related to, and embodiments of, methods and apparatus according to the present disclosure. It should be appreciated that various embodiments of the subject matter introduced above and discussed in greater detail below may be implemented in any of numerous ways, as the subject matter is not limited to any particular manner of implementation. Examples of specific implementations and applications are provided primarily for illustrative purposes.

Referring to the Figures, FIGS. 1-8 and FIGS. 10-11 illustrate a luggage connector assembly for ease of transport of various luggage members has one or more telescopically retractable knob assemblies 200 slidably coupled to a first portable case assembly 100, the one or more telescopically retractable knob assemblies 200 having, a distal end portion 290, a middle portion 250, and a proximal end portion 210, the middle portion 250 narrower than the distal end portion 290 and the proximal end portion 210. One or more C-shaped latch assemblies 400 with an upper portion 490 and a lower portion 410 is coupled to at least one second portable case assembly 300 and is designed to slidably receive the proximal end portion 210 of the one or more telescopically retractable knob assemblies 200 when the one or more telescopically retractable knob assemblies 200 is in an extended position. A substantially rigid arch assembly 600 is disposed within the lower portion of the one or more C-shaped latch assemblies 490 and is designed to restrain the sideways movement of the proximal end portion 210 of the one or more telescopically retractable knob assemblies 200.

In this example embodiment, at least one slotted rail pair assembly 700 is coupled to the first portable case assembly 100 with the at least one slotted rail pair assembly 700 having a right side portion 760 and a left side portion 740, the at least one slotted rail pair assembly 700 further having a proximal face 710 and a distal face 790. A gap 750 separates the right side portion of the at least one slotted rail pair 760 and the left side portion of the at least one slotted rail pair 740 through which the middle portion 250 of the one or more telescopically retractable knob assemblies 200 are disposed, the gap narrower than the width of the distal end portion 290 and the proximal end portion 210 of the one or more telescopically retractable knob assemblies 200 and designed to restrain the one or more telescopically retractable knob assemblies 200 from sideways movement while permitting longitudinal movement. One embodiment of the luggage connector assembly may include the first portable case assembly 100, the second portable case assembly 300, and a third portable case assembly 500. In one embodiment of the luggage connector assembly, at least the first portable case assembly has four wheel assemblies 550 coupled to a base portion of the portable case assembly 190, the four wheel assemblies 550 each having at least one wheel member 551.

Figure 9A:
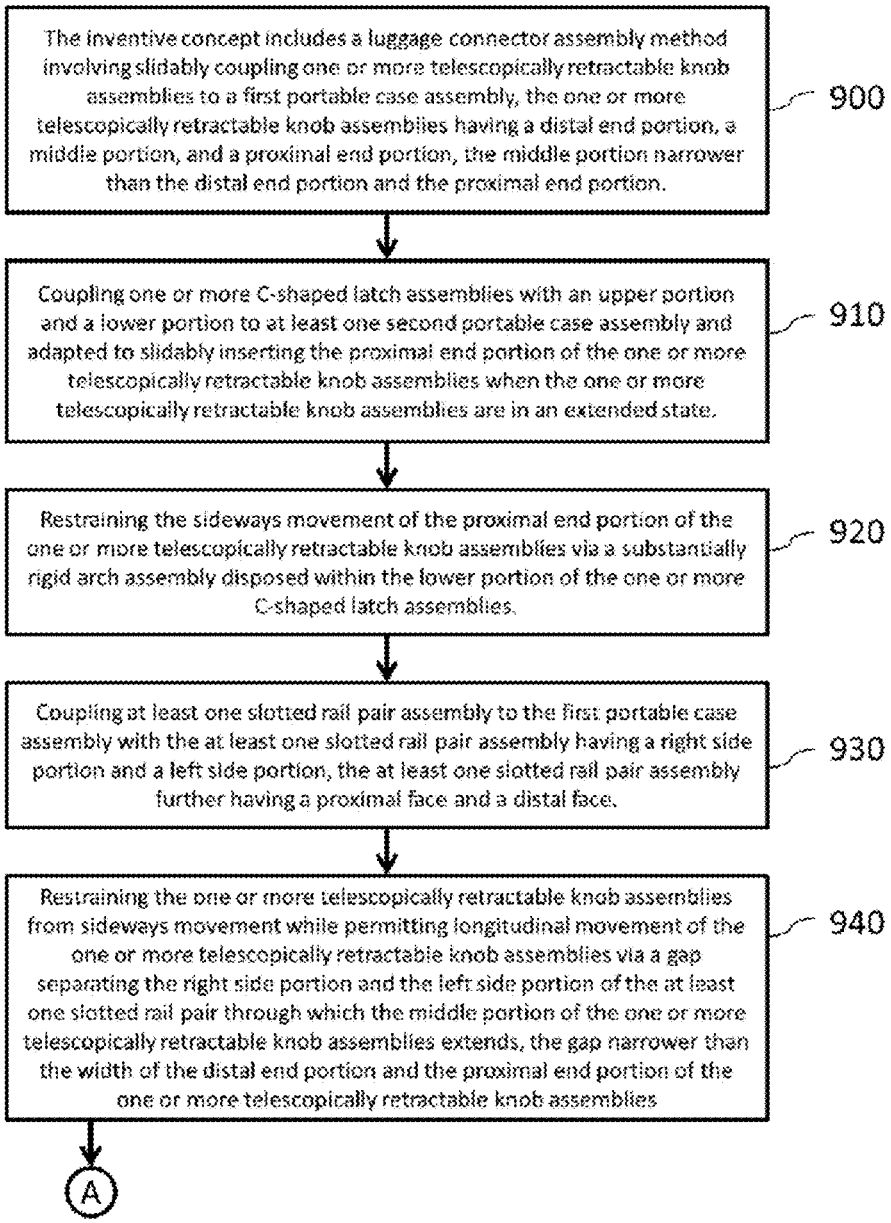
FIGS. 9A-9B illustrate a method of using the luggage connector assembly.
Figure 9B:
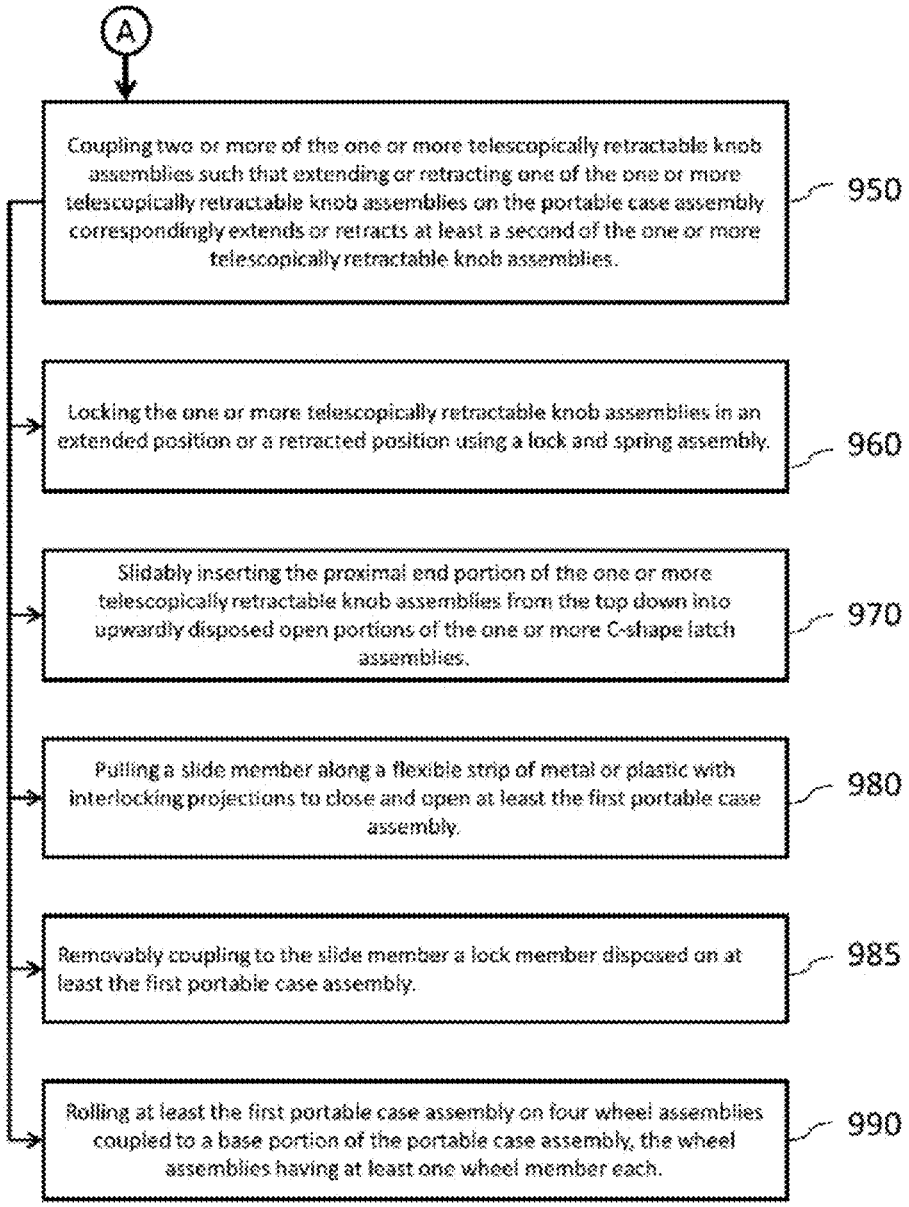
Figure 10:
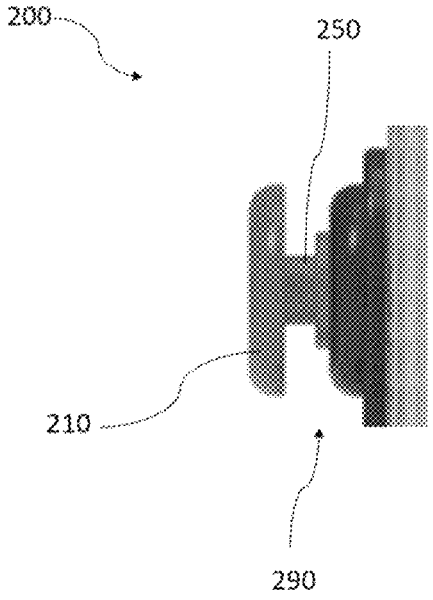
FIG. 10 illustrates a knob assembly.
Figure 11:
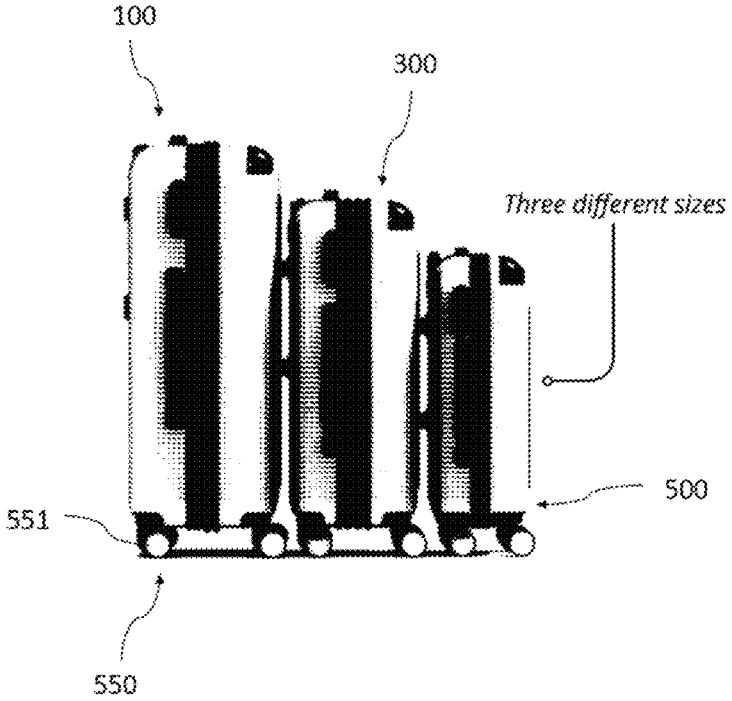
FIG. 11 illustrates a luggage connector assembly for ease of transport of various luggage members.

Another example embodiment of the luggage connector assembly includes the method, described in FIGS. 9A-9B, of coupling more than one luggage member together for ease of transport, the method comprising the steps of slidably coupling one or more telescopically retractable knob assemblies to a first portable case assembly, the one or more telescopically retractable knob assemblies having a distal end portion, a middle portion, and a proximal end portion, the middle portion narrower than the distal end portion and the proximal end portion 900. One or more C-shaped latch assemblies is coupled with an upper portion and a lower portion to at least one second portable case assembly by slidably inserting the proximal end portion of the one or more telescopically retractable knob assemblies when the one or more telescopically retractable knob assemblies are in an extended position 910. The sideways movement of the proximal end portion of the one or more telescopically retractable knob assemblies is restrained via a substantially rigid arch assembly disposed within the lower portion of the one or more C-shaped latch assemblies 920. At least one slotted rail pair assembly is coupled to the first portable case assembly with the at least one slotted rail pair assembly having a right-side portion and a left side portion, the at least one slotted rail pair assembly further having a proximal face and a distal face 930.

In this example embodiment, one or more telescopically retractable knob assemblies is restrained from sideways movement while permitting longitudinal movement of the one or more telescopically retractable knob assemblies via a gap separating the right side portion and the left side portion of the at least one slotted rail pair through which the middle portion of the one or more telescopically retractable knob assemblies extends, the gap narrower than the width of the distal end portion and the proximal end portion of the one or more telescopically retractable knob assemblies 940.

One embodiment of the luggage connector assembly method, described in FIGS. 9A-9B, includes the step of functionally coupling two or more of the one or more telescopically retractable knob assemblies such that extending or retracting one of the one or more telescopically retractable knob assemblies on the portable case assembly correspondingly extends or retracts at least a second of the one or more telescopically retractable knob assemblies 950.

One embodiment of the luggage connector assembly method includes the step of locking the one or more telescopically retractable knob assemblies in an extended position or a retracted position using a lock and spring assembly 960.

One embodiment of the luggage connector assembly method includes the step of slidably inserting the proximal end portion of the one or more telescopically retractable knob assemblies from the top down through upwardly disposed open portions of the one or more C-shape latch assemblies 970.

One embodiment of the luggage connector assembly method includes the step of pulling a slide member along a flexible strip of metal or plastic with interlocking projections to close and open at least the first portable case assembly 980.

One embodiment of the luggage connector assembly method includes removably coupling a lock member disposed on at least the first portable case assembly to the slide member when in a locked state 985.

One embodiment of the luggage connector assembly method includes the step of rolling at least the first portable case assembly on four-wheel assemblies coupled to a base portion of the portable case assembly, the wheel assemblies having at least one wheel member each 990.

The following patents and documents are incorporated by reference in their entireties: U.S. Pat. No. 6,410,871 along with WO1999035931A1, WO2010077481A2, and a reference to a Tach Tech solution.

While the inventive concept has been described above in terms of specific embodiments, it is to be understood that the inventive concept is not limited to these disclosed embodiments. Upon reading the teachings of this disclosure, many modifications and other embodiments of the inventive concept will come to mind of those skilled in the art to which this inventive concept pertains, and which are intended to be and are covered by both this disclosure and the appended claims. It is indeed intended that the scope of the inventive concept should be determined by proper interpretation and construction of the appended claims and their legal equivalents, as understood by those of skill in the art relying upon the disclosure in this specification and the attached drawings.

The invention claimed is:

1. A luggage connector assembly for ease of transport of various luggage members comprising:

one or more telescopically retractable knob assemblies slidably coupled to a first portable case assembly, the one or more telescopically retractable knob assemblies having a distal end portion, a middle portion, and a proximal end portion, the middle portion narrower than the distal end portion and the proximal end portion;

one or more C-shaped latch assemblies with an upper portion and a lower portion coupled to at least one second portable case assembly and adapted to slidably receive the proximal end portion of the one or more telescopically retractable knob assemblies when the one or more telescopically retractable knob assemblies are in an extended position;

a substantially rigid arch assembly disposed within the lower portion of the one or more C-shaped latch assemblies adapted to restrain the sideways movement of the proximal end portion of the one or more telescopically retractable knob assemblies;

at least one slotted rail pair assembly coupled to the first portable case assembly with the at least one slotted rail pair assembly having a right side portion and a left side portion, the at least one slotted rail pair assembly further having a proximal face and a distal face; and a gap separating the right side portion and the left side portion of the at least one slotted rail pair through which the middle portion of the one or more telescopically retractable knob assemblies are disposed, the gap narrower than the width of the distal end portion and the proximal end portion of the one or more telescopically retractable knob assemblies and adapted to restrain the one or more telescopically retractable knob assemblies from sideways movement while permitting longitudinal movement of the one or more telescopically retractable knob assemblies.

2. The luggage connector assembly of claim 1 wherein two or more of the one or more telescopically retractable knob assemblies are functionally coupled such that extending or retracting one of the one or more telescopically retractable knob assemblies on the portable case assembly correspondingly extends or retracts at least a second of the one or more telescopically retractable knob assemblies.

3. The luggage connector assembly of claim 1 wherein the one or more telescopically retractable knob assemblies are locked in an extended position or a retracted position using a lock and spring assembly.

4. The luggage connector assembly of claim 1 wherein the open portion of the C-shape latch assemblies are upwardly disposed and adapted to slidably receive and couple to the proximal end portion of the one or more telescopically retractable knob assemblies from the top.

5. The luggage connector assembly of claim 1 wherein at least one flexible strip of metal or plastic with interlocking projections, the flexible strip of metal or plastic with interlocking projections closed and opened by pulling a slide member along them, is disposed on at least the first portable case assembly.

6. The luggage connector assembly of claim 5 wherein a lock member is disposed on at least the first portable case assembly adapted to be removably coupled to the slide member when in a locked state.

7. The luggage connector assembly of claim 1 wherein at least the first portable case assembly has four wheel assemblies coupled to a base portion of the portable case assembly, the four wheel assemblies each having at least one wheel member.

8. A luggage connector assembly method of coupling more than one luggage member together for ease of transport, the method comprising the steps of:

slidably coupling one or more telescopically retractable knob assemblies to a first portable case assembly, the one or more telescopically retractable knob assemblies having a distal end portion, a middle portion, and a proximal end portion, the middle portion narrower than the distal end portion and the proximal end portion;

coupling one or more C-shaped latch assemblies with an upper portion and a lower portion to at least one second portable case assembly by slidably inserting the proximal end portion of the one or more telescopically retractable knob assemblies when the one or more telescopically retractable knob assemblies are in an extended position;

restricting the sideways movement of the proximal end portion of the one or more telescopically retractable knob assemblies via a substantially rigid arch assembly disposed within the lower portion of the one or more C-shaped latch assemblies;

coupling at least one slotted rail pair assembly to the first portable case assembly with the at least one slotted rail pair assembly having a right side portion and a left side portion, the at least one slotted rail pair assembly further having a proximal face and a distal face; and restricting the one or more telescopically retractable knob assemblies from sideways movement while permitting longitudinal movement of the one or more telescopically retractable knob assemblies via a gap separating the right side portion and the left side portion of the at least one slotted rail pair through which the middle portion of the one or more telescopically retractable knob assemblies extends, the gap narrower than the width of the distal end portion and the proximal end portion of the one or more telescopically retractable knob assemblies.

9. The luggage connector assembly method of claim 8 involving the step of functionally coupling two or more of the one or more telescopically retractable knob assemblies such that extending or retracting one of the one or more telescopically retractable knob assemblies on the portable case assembly correspondingly extends or retracts at least a second of the one or more telescopically retractable knob assemblies.

10. The luggage connector assembly method of claim 8 involving the step of locking the one or more telescopically retractable knob assemblies in an extended position or a retracted position using a lock and spring assembly.

11. The luggage connector assembly method of claim 8 involving the step of slidably inserting the proximal end portion of the one or more telescopically retractable knob assemblies from the top down into upwardly disposed open portions of the one or more C-shape latch assemblies.

12. The luggage connector assembly method of claim 8 involving the step of pulling a slide member along a flexible strip of metal or plastic with interlocking projections to close and open at least the first portable case assembly.

13. The luggage connector assembly method of claim 12 involving the step of removably coupling to the slide member a lock member disposed on at least the first portable case assembly.

14. The luggage connector assembly method of claim 8 involving the step of rolling at least the first portable case assembly on four-wheel assemblies coupled to a base portion of the portable case assembly, the wheel assemblies having at least one wheel member each.

15. A luggage connector assembly for ease of transport of various luggage members comprising:

one or more telescopically retractable knob assemblies slidably coupled to each of a first portable case assembly, a second portable case assembly, and a third portable case assembly, the one or more telescopically retractable knob assemblies having a distal end portion, a middle portion, and a proximal end portion, the middle portion narrower than the distal end portion and the proximal end portion;

one or more C-shaped latch assemblies with an upper portion and a lower portion disposed on each of the first portable case assembly, the second portable case assembly, and the third portable case assembly to at least one or more of the first portable case assembly, the second portable case assembly, and the third portable case assembly and adapted to slidably receive the proximal end portion of the one or more telescopically retractable knob assemblies when the one or more telescopically retractable knob assemblies are in an extended position;

a substantially rigid arch assembly disposed within the lower portion of the one or more C-shaped latch assemblies adapted to restrain the sideways movement of the proximal end portion of the one or more telescopically retractable knob assemblies;

at least one slotted rail pair assembly coupled to each the first portable case assembly, the second portable case assembly, and the third portable case assembly, with the at least one slotted rail pair assembly having a right side portion and a left side portion, the at least one slotted rail pair assembly on each the first portable case assembly, the second portable case assembly, and the third portable case assembly further having a proximal face and a distal face; and a gap separating the right side portion and the left side portion of the at least one slotted rail pair each the first portable case assembly, the second portable case assembly, and the third portable case assembly through which the middle portion of the one or more telescopically retractable knob assemblies are disposed, the gap narrower than the width of the distal end portion and the proximal end portion of the one or more telescopically retractable knob assemblies and adapted to restrain the one or more telescopically retractable knob assemblies from sideways movement while permitting longitudinal movement of the one or more telescopically retractable knob assemblies.

16. The luggage connector assembly of claim 15 wherein two or more of the one or more telescopically retractable knob assemblies are functionally coupled such that extending or retracting one of the one or more telescopically retractable knob assemblies on each the first portable case assembly, the second portable case assembly, and the third portable case assembly correspondingly extends or retracts at least a second of the one or more telescopically retractable knob assemblies on the respective first portable case assembly, second portable case assembly, and third portable case assembly.

17. The luggage connector assembly of claim 15 wherein the one or more telescopically retractable knob assemblies on each the first portable case assembly, the second portable case assembly, and the third portable case assembly is locked in an extended position or a retracted position using a lock and spring assembly.

18. The luggage connector assembly of claim 15 wherein the open portion of the C-shape latch assemblies are upwardly disposed and adapted to slidably receive and couple to the proximal end portion of the one or more telescopically retractable knob assemblies from the top.

19. The luggage connector assembly of claim 15 wherein at least one flexible strip of metal or plastic with interlocking projections is disposed on at least the first portable case assembly and is closed and opened by pulling a slide member along the flexible strip of metal or plastic with interlocking projections, a lock member disposed on at least the first portable case assembly adapted to be removably coupled to the slide member when in a locked state.

20. The luggage connector assembly of claim 15 wherein each the first portable case assembly, the second portable case assembly, and the third portable case assembly has four wheel assemblies coupled to a base portion of each the first portable case assembly, the second portable case assembly, and the third portable case assembly, the wheel assemblies having at least one wheel member each.

* * * * *